US007231057B2

(12) United States Patent
Kim et al.

(10) Patent No.: US 7,231,057 B2
(45) Date of Patent: Jun. 12, 2007

(54) MULTI-FUNCTION ACTUATOR CAPABLE OF PREVENTING VIBRATION

(75) Inventors: Sang Won Kim, Seoul (KR); Seuk Hwan Chung, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 432 days.

(21) Appl. No.: 10/953,789

(22) Filed: Sep. 30, 2004

(65) Prior Publication Data

US 2006/0002578 A1 Jan. 5, 2006

(30) Foreign Application Priority Data

Jul. 2, 2004 (KR) ..... 10-2004-0051421

(51) Int. Cl.
*H04R 25/00* (2006.01)

(52) U.S. Cl. ..... 381/396; 381/400; 381/401; 381/412

(58) Field of Classification Search ..... 381/396, 381/400–406, 412, 414; 340/7.6, 7.58, 388.1; 455/567

See application file for complete search history.

(56) References Cited

U.S. PATENT DOCUMENTS 6,553,125 B2 * 4/2003 Kobayashi et al. ..... 381/396
6,681,025 B2 * 1/2004 Maekawa ..... 381/396
2002/0114486 A1 8/2002 Fukawatase et al.

FOREIGN PATENT DOCUMENTS

| | | |
|---|---|---|
| FR | 2771576 | 5/1999 |
| GB | 2262606 | 6/1993 |
| JP | 06113002 | 4/1994 |
| KR | 200334302 | 5/2003 |

* cited by examiner

*Primary Examiner*—Curtis Kuntz
*Assistant Examiner*—Tuan Duc Nguyen
(74) *Attorney, Agent, or Firm*—Lowe Hauptman & Berner

(57) ABSTRACT

The present invention relates to a multi-function actuator, in which a voice coil vibrates a sound-generating diaphragm in response to an audio signal. A vibration coil is placed on a central axis coaxial with the voice coil for generating vibration in response to the audio signal or a vibration signal. A vibration unit includes a magnet for generating a magnetic field to both of the voice coil and the vibration coil and a yoke having a predetermined mass. The vibration unit is vertically vibrated by an electromagnetic force produced from at least one of the voice coil and the vibration coil. A switch selectively applies the audio signal to the vibration coil. The multi-function actuator can prevent the vibration of the vibration unit during sound generation in response to user's switch selection.

6 Claims, 11 Drawing Sheets

MULTI-FUNCTION ACTUATOR CAPABLE OF PREVENTING VIBRATION

RELATED APPLICATION

The present application is based on, and claims priority from, Korean Application Number 2004-51421, filed on Jul. 2, 2004, the disclosure of which is hereby incorporated by reference herein in its entirety.

BACKGROUND OF THE INVENTION

1. Field of the Invention

The present invention relates to a multi-function actuator capable of preventing vibration. More particularly, the multi-function actuator of the present invention can prevent the vibration of a vibration unit during sound generation in response to user's switch selection.

2. Description of the Related Art

A multi-function actuator generally means a small sized vibration and sound-generating apparatus that functions to output audible sound from electrically received audio signals or previously inputted bell or melody. Such multi-function actuators are mounted on various mobile communication systems such as a mobile phone, pager, gaming system and headset.

FIG. 1 illustrates a conventional multi-function actuator, as will be described hereinafter.

A conventional multi-function actuator 100 includes a hollow housing 110, a sound generating diaphragm 121 fixed by the outer circumference to the top of the housing 110, a voice coil 122 cylindrically wound and fixed to the bottom of the diaphragm 121, a vertically magnetized magnet 123, a yoke 131 forming a magnetic circuit together with the magnet 123, a weight 133 forming a vibrator together with the yoke 131 and upper and lower leaf springs 132 and 132' supporting the vibrator at the top and the bottom, respectively.

Lines of magnetic force from the N pole of the magnet 123 are directed to the S pole of the magnet 123 through the voice coil 122 and the yoke 131 in their order thereby forming a magnetic field. The voice coil 122 functions as a speaker to generate sound by using magnetic flux from the magnetic circuit including the magnet 123 and the yoke 131.

In the meantime, application of low frequency voltage to the voice coil 122 induces vertical movement to the vibrator, which further includes the weight 133 together with the magnet 123 and the yoke 131 of the magnetic circuit, thereby generating vibration.

The conventional multi-function actuator generates vibration in a relatively lower frequency range but sound in a relatively higher frequency range based upon resonant frequency.

However, when used as mobile communication devices or for other purposes, the conventional multi-function actuator has a problem in that sound generation is accompanied with vibration because the frequency range of audio signals gradually expands into the low frequency range.

In particular, the afore-described conventional actuator 100 is prone to have various problems associated with controlling such as overlapping in frequency, etc., since it is designed to generate both of sound and vibration by inputting frequency signals into a single signal source or the voice coil 122.

FIG. 2 illustrates another conventional actuator which additionally has a vibration coil to improve some of the above problems, as will be described hereinafter.

The conventional actuator 200 includes a cylindrical outer frame 210, a sound unit 220, which comprises a diaphragm 221, a voice coil 222 and a sound magnet 223, and a vibration unit 230, which comprises a yoke 231, a vibration coil 232 and a vibration magnet 233. The sound unit 220 and the vibration unit 230 are placed inside the cylindrical outer frame 210

In the outer periphery of the outer frame 210, there is provided a terminal plate for supplying external voltage to the voice coil 222 and the vibration coil 232.

In the inner periphery of the outer frame 210, there are provided an upper leaf spring 240 and a lower leaf spring 240'. An annular acoustic magnet 223 is mounted on the bottom of the upper leaf spring 240 and the top of the lower leaf spring 240'. An inner frame is coupled with the top of the sound magnet 223 and the upper leaf spring 240.

The voice coil 222 is connected with the terminal plate. When a voltage having a predetermined frequency or more is supplied to the voice coil 222, the voice coil 222 is vertically vibrated by an electromagnetic force produced through the interaction between a magnetic field generated from the sound magnet 223 and an electric field generated around the voice coil 222.

This vertically vibrates the diaphragm 221 coupled integrally with the voice coil 222 thereby producing sound.

In the meantime, the vibration coil 232 is connected with a different terminal plate. When a voltage having a predetermined frequency or more is supplied from this terminal plate to the vibration coil 232, the yoke 231 is vertically vibrated by an electromagnetic force produced through the interaction between a magnetic field of the vibration magnet 233 and an electric field generated around the vibration coil 232. The vibratory force of the yoke 231 is transmitted to the outer frame 210 through the upper and lower leaf springs 240 and 240', and the vibratory force of the outer frame 210 is transmitted to the outside.

This as a result generates vibration to inform call incoming.

Although the above actuator is so structured that the sound unit 220 is separated from the vibration unit 230 in order to avoid any interference between them, this still has a problem of vibration since it is impossible to prevent the reaction of the vibration unit 230 in the event that the diaphragm 221 of the sound unit 220 is vibrated to generate sound.

Accordingly, a multi-function actuator, which can prevent vibration resulting from sound generation in response to user selection, has been required in the art in order to prevent such problems.

SUMMARY OF THE INVENTION

The present invention has been made to solve the foregoing problems of the prior art and it is therefore an object of the present invention to provide a multi-function actuator, in which when an audio signal is applied simultaneously to both of voice and vibration coils in response to user's switch selection, electromagnetic forces applied onto a vibration unit by the voice coil and vibration coils are directed counter to each other on the same axis to cancel out each other thereby preventing the vibration of the vibration unit.

According to an aspect of the present invention for realizing the object, there is provided a multi-function actuator comprising: a diaphragm for generating sound; a voice coil for vibrating the diaphragm in response to an audio signal; a vibration coil placed on a central axis coaxial with the voice coil for generating vibration in response to the audio signal or a vibration signal; a vibration unit including a magnet for generating a magnetic field to both of the voice coil and the vibration coil and a yoke having a predetermined mass, the vibration unit being vertically vibrated by an electromagnetic force produced from at least one of the voice coil and the vibration coil; and a switch for selectively applying the audio signal to the vibration coil, wherein when an audio signal is applied simultaneously to both of the voice and vibration coils in response to the operation of the switch, the electromagnetic forces applied onto the vibration unit by the voice and vibration coils become coaxial with and counter to each other to cancel out themselves thereby preventing the vibration of the vibration unit.

As another aspect of the present invention, the magnet may be annular shaped, wherein the voice coil is preferably placed outside the annular magnet, and the vibration coil is preferably placed inside the annular magnet.

Alternatively, the voice coil is preferably placed inside the annular magnet, and the vibration coil is preferably placed outside the annular magnet.

As other aspect of the present invention, the magnet may be cylindrically shaped, wherein it is preferred that the voice and vibration coils are arranged vertically outside the cylindrical magnet.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

Figure 1:
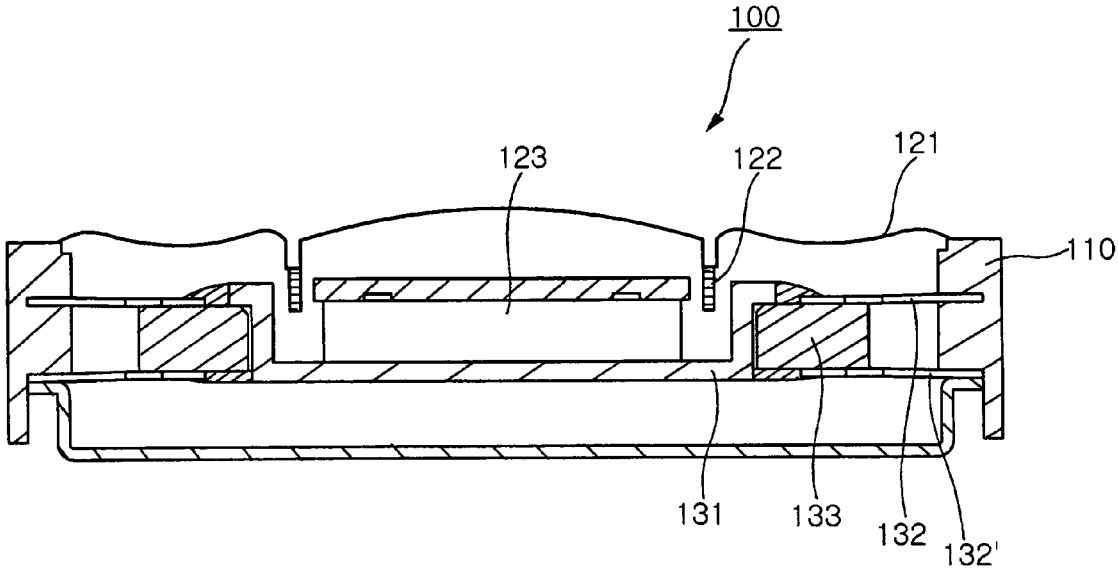
PRIOR ART FIG. 1
FIG. 1 illustrates a side section of a conventional multi-function actuator.
Figure 2:
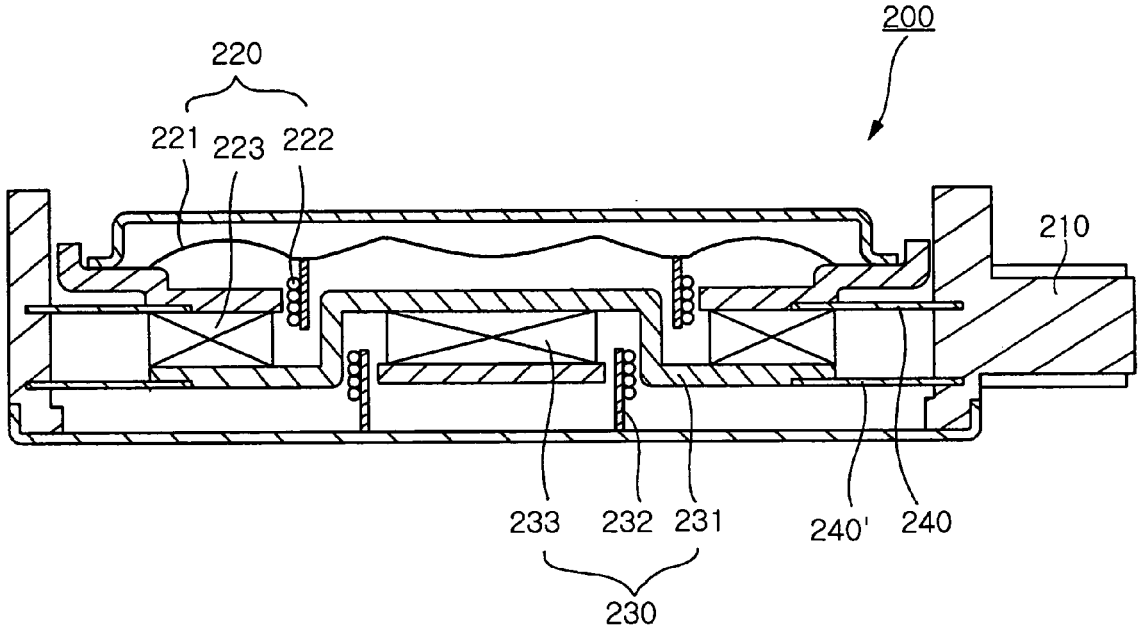
PRIOR ART FIG. 2
FIG. 2 illustrates a side section of another conventional multi-function actuator.
Figure 3:
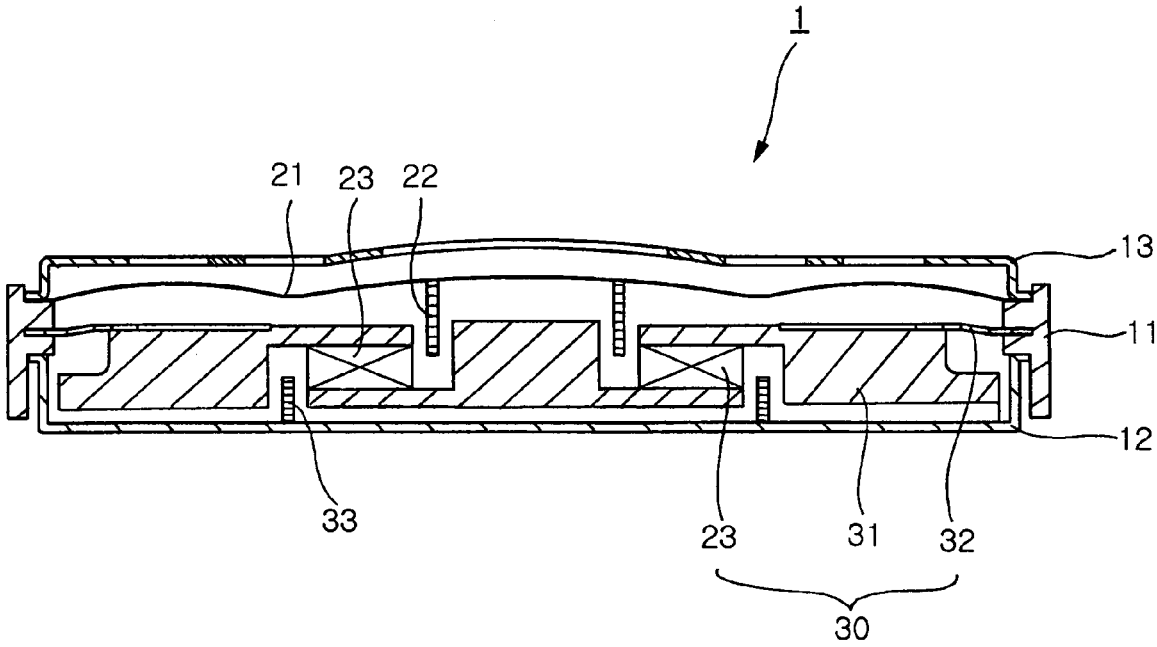
FIG. 3 illustrates a side section of a multi-function actuator according to a first embodiment of the present invention.

FIG. 3 illustrates a side section of a multi-function actuator according to a first embodiment of the present invention, as will be described hereinafter.

A multi-function actuator 1 of the present invention is an actuator for generating sound and vibration in response to input electric signals, and includes a diaphragm 21 for generating sound, a voice coil 22 for vibrating the diaphragm 21 in response to an audio signal, a vibration coil 33 for generating vibration in response to an audio or vibration signal, a magnet 23 for generating a magnetic field to both of the voice coil 22 and the vibration coil 33, a vibration unit 30 having a yoke 31 of a predetermined mass for vertically vibrating by an electromagnetic force generated from the voice coil 22 and/or the vibration coil 33 and a switch (not shown) for selectively applying the audio signal to the vibration coil 33.

Generally in the actuator, when the diaphragm 21 is vertically vibrated to generate sound in response to the audio signal, the vibration unit 30 is also vibrated as a reaction to the vertical vibration of the diaphragm. However, this is an unnecessary operation, which a user may dislike.

Accordingly the present invention is so devised that when an audio signal is applied simultaneously to both of the voice and vibration coils 22 and 33 in response to switch selection, electromagnetic forces applied onto the vibration unit 30 by the voice coil and vibration coils 22 and 33 are directed counter to each other on the same axis to cancel themselves thereby preventing the vibration of the vibration unit 30.

As shown in FIG. 3, the diaphragm 21 may be placed in the inner periphery of the top of the hollow housing 21.

The hollow housing 11 is opened at the top and the bottom, and a lower cover 12 is coupled with the bottom of the hollow housing 11. The actuator further comprises an upper cover 13 for closing the top of the hollow housing 11.

The voice coil 22 is cylindrically wound on the bottom of the diaphragm 21, and serves to vibrate the diaphragm 21 in response to an audio signal.

The vibration unit 30 includes the magnet 23 for applying a magnetic field to both of the voice and vibration coils 22 and 33 and the yoke 31 of a predetermined mass. An electromagnetic force generated from at least one of the voice coil 22 and the vibration coil 33 vertically vibrates the vibration unit 30.

Herein the yoke 31 has a predetermined mass to function as a weight.

The vibration unit 30 also has a leaf spring 32 that is fixed by the outer circumference to the inner circumference of the housing 11, and the vibratory force of the vibration unit 30 can be transmitted to the housing 11 through the leaf spring 32 and then to the outside.

The vibration coil 33 is cylindrically wound on the top of the lower cover 12 which is coupled with the bottom of the hollow housing 11, and preferably provided on the central axis coaxial with the voice coil 22.

As not shown, the present invention may further have a switch which can prevent vibration in response to user selection.

As described above, when audio signals are simultaneously applied to both of the voice coil 22 and the vibration coil 33 through the operation of the switch, the voice and vibration coils 22 and 33 apply electromagnetic forces onto the vibration unit 30. Because the electromagnetic forces are coaxial with and directed counter to each other, they cancel out themselves thereby preventing the vibration of the vibration unit 30.

Figure 4:
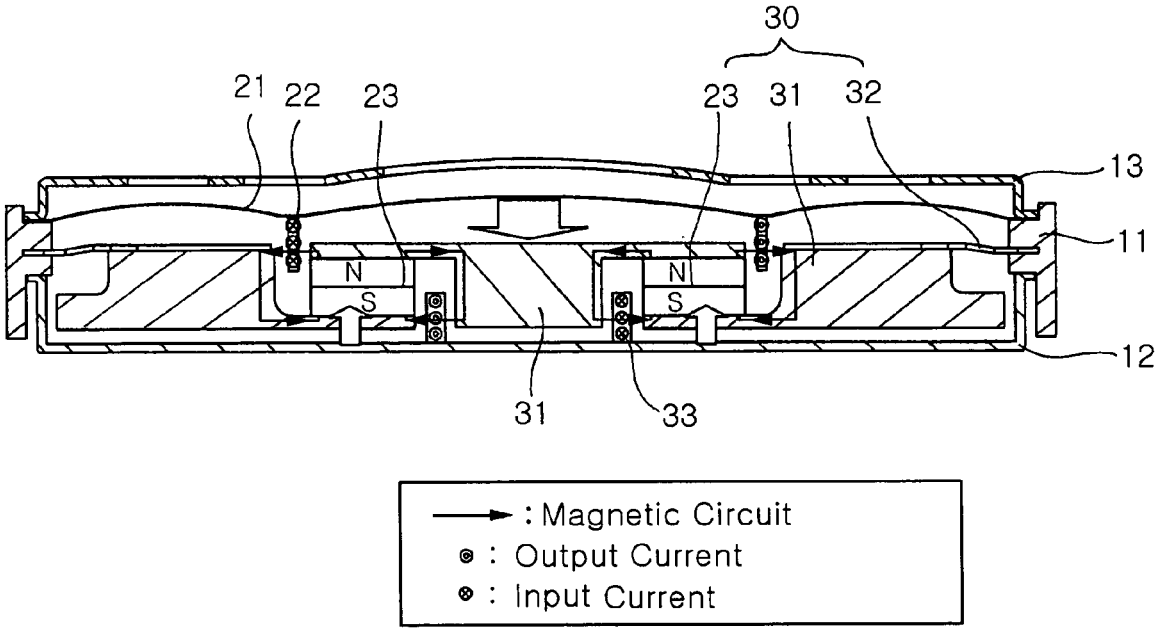
FIG. 4 illustrates a magnetic field flow in the actuator according to the first embodiment of the present invention.

FIG. 4 illustrates a magnetic field flow in the actuator of the present invention, as will be described hereinafter.

Lines of magnetic force from the N pole of the magnet 23 are directed through the yoke 31 and the voice coil 22 to the S pole of the magnet 23 thereby forming a magnetic field.

Then, the voice coil 22 is vertically vibrated through the interaction between a magnetic field generated by the magnet 23 and an electric field generated around the voice coil 22. This as a result vertically vibrates the diaphragm 21 thereby generating sound (in which a magnetic circuit is represented with arrows).

Then, as a reaction to the vertical vibration of the diaphragm 21, the vibration unit 30 is also vibrated.

Therefore, the present invention is devised to generate magnetic fields of the opposite direction from the voice and vibration coils in response to user's switch selection in order to prevent vibration resulting from sound generation.

Figure 5:
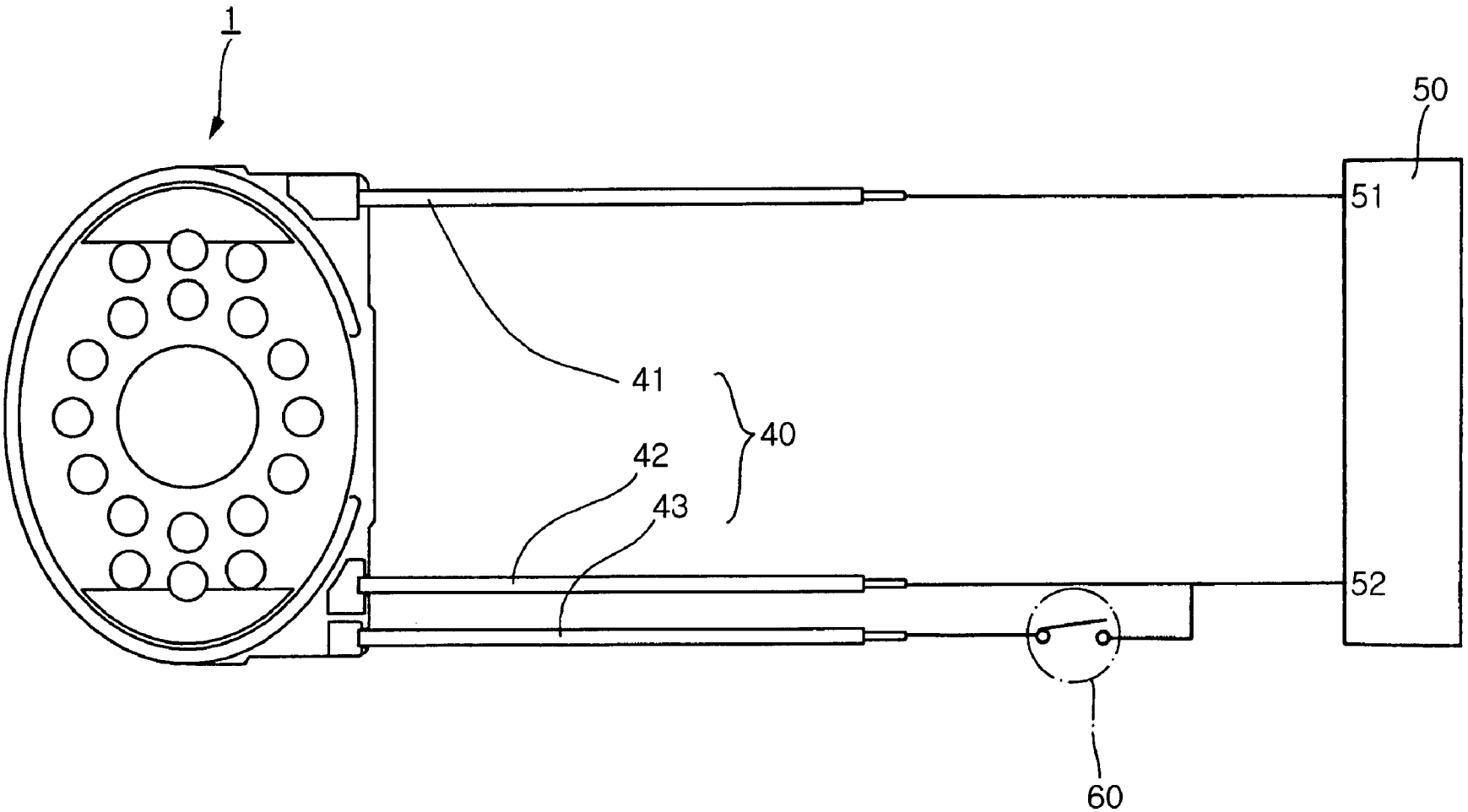
FIGS. 5 to 7 schematically illustrate an anti-vibration function performed by the multi-function actuator according to the first embodiment of the present invention.
Figure 6:
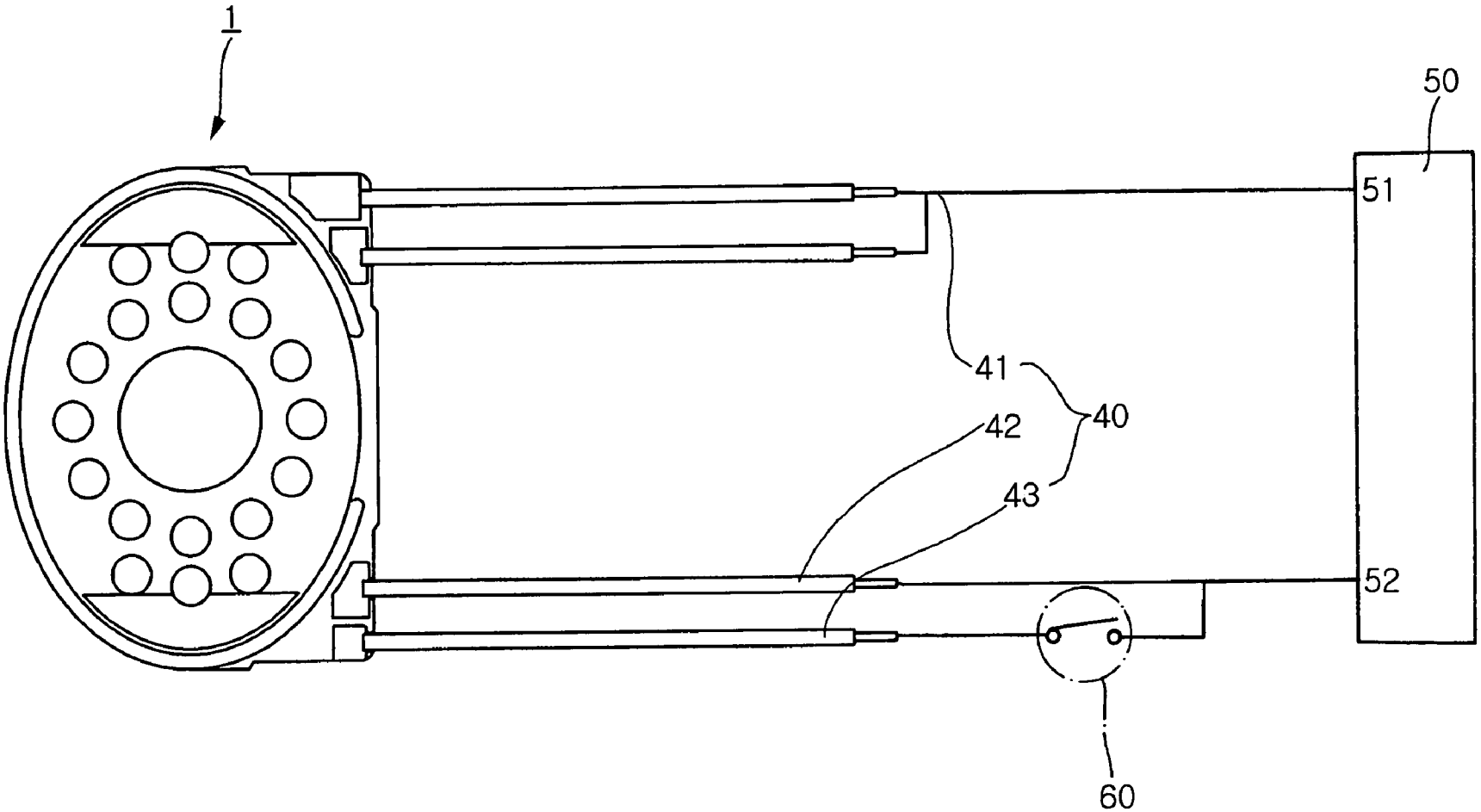
Figure 7:
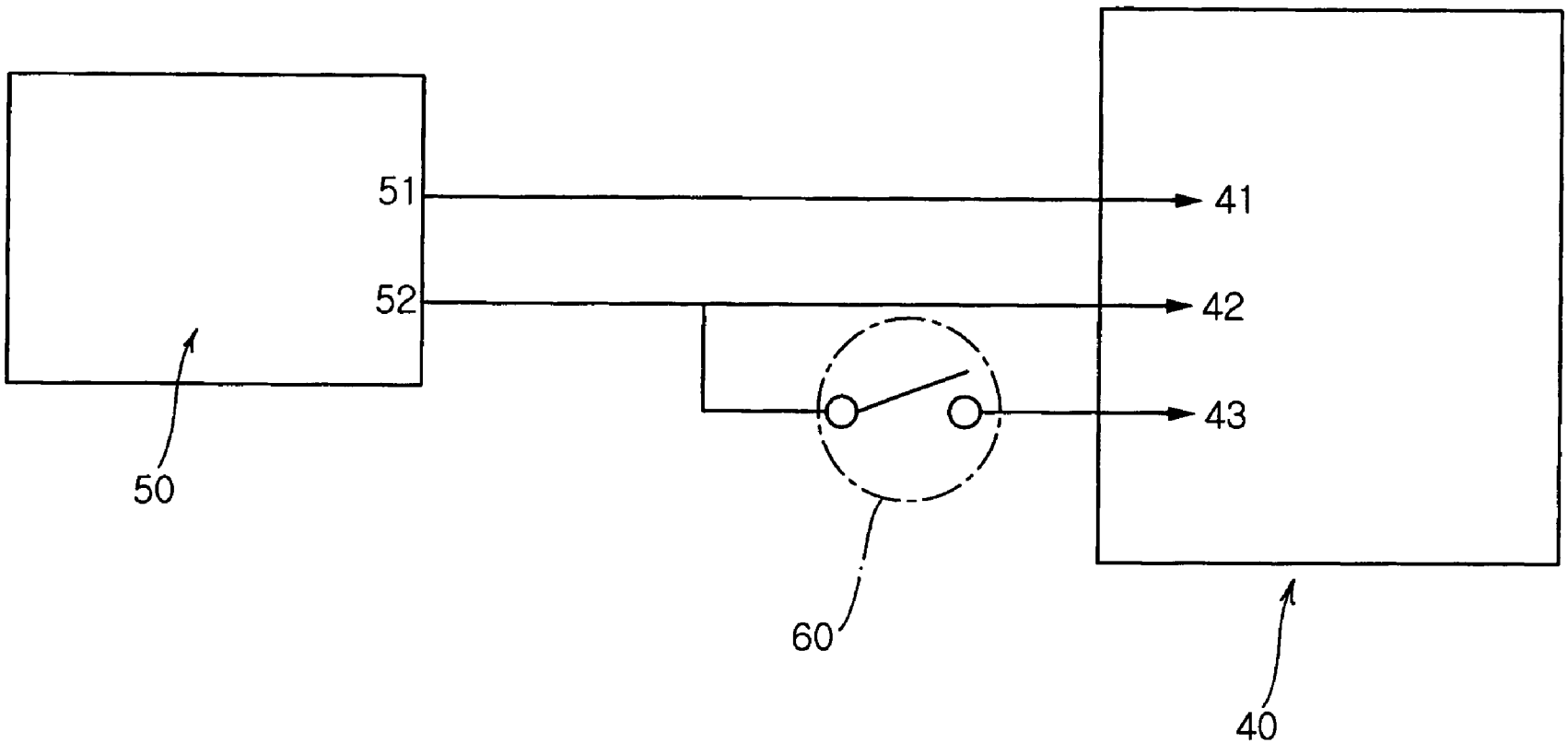

Referring to FIGS. 5 to 7, the vibration generating function of the present invention will be described as follows:

As described hereinbefore, the present invention is characterized in that the electromagnetic forces applied onto the vibration unit by the voice and vibration coils are directed counter to each other during sound generation in response to user selection to cancel out themselves thereby preventing vibration.

For the purpose of this, the present invention includes for example a terminal unit 40 having terminals of the voice coil and coils, a melody drive unit 50 for generating audio signals and a switch 60.

The terminal unit 40 includes a first terminal 41 earthed in common to one end of the voice coil 22 and one end of the vibration coil 33, a second terminal 42 as the other end of the voice coil 22 and a third terminal 43 as the other end of the vibration coil 33.

The one ends of the voice coil 22 and the vibration coil 33 may be earthed inside or outside the actuator 1 of the present invention.

That is, if the one ends of the voice coil 22 and the vibration coil 33 are earthed inside the actuator 1, the terminal unit 40 may be provided with three terminals extended to the outside as shown in FIG. 5. If the one ends of the voice and vibration coils 22 and 33 are earthed outside the actuator 1, the terminal unit 40 may be provided with four terminals extended to the outside as shown in FIG. 6.

The melody drive unit 50 may be installed outside the actuator, and include an earth terminal 51 and a signal terminal 52.

The earth terminal 51 is connected with the first terminal 41 of the terminal unit 40 and the signal terminal 52 is connected with the second terminal 42 so that an audio signal may be applied during sound generation.

The switch 60 is placed between the second and third terminals 42 and 43, which are connected with each other, in order to apply an electric signal to the vibration coil in response to user selection.

That is, when the switch 60 is turned on in response to user selection, an audio signal is applied simultaneously to both of the voice and vibration coils to prevent vibration.

Of course, when the switch 60 is turned off in response to user selection, the audio signal is applied only to the voice coil thereby generating vibration to the vibration unit 30 as a reaction to the vertical vibration of the diaphragm 21.

The first embodiment of the present invention of the above structure will be described with reference to FIGS. 3 and 4.

As an example of the actuator of the present invention, the magnet 23 of the vibration unit 30 may be annular shaped In this case, the voice and vibration coils 22 and 33 may be arranged inside and outside the annular magnet 23, respectively.

That is, as shown in FIG. 3, the voice coil 22 is placed inside the annular magnet 23, and the vibration coil 33 is placed outside the annular magnet 23.

Alternatively, as shown in FIG. 3, the voice coil 22 is placed outside the annular magnet 23, and the vibration coil 33 is placed inside the annular magnet 23.

In this case, as described above, the configuration of the annular magnet 23 causes the magnetic fluxes generated from the coils 22 and 23 to have the same direction.

As a consequence, when an audio signal is applied simultaneously to the voice and vibration coils 22 and 33 in response to user's switch selection, electric currents of the opposite direction flow through the voice and vibration coils 22 and 33. Then, electromagnetic forces generated by the voice coil 22 and the vibration coil 33 are directed counter to each other according to Fleming's left hand rule. This cancels out the electromagnetic forces from the voice and vibration coils 22 and 33 thereby preventing the vibration of the vibration unit 30.

Of course, when the switch 60 is turned off in response to user selection, the audio signal is applied only to the voice coil 22 so that the vibration unit 30 is vibrated as a reaction to the vertical vibration of the diaphragm 21.

Hereinafter several examples by which electric currents of the opposite direction flow through the voice and vibration coils 22 and 33 will be described with reference to FIGS. 8 to 11.

Figure 8:
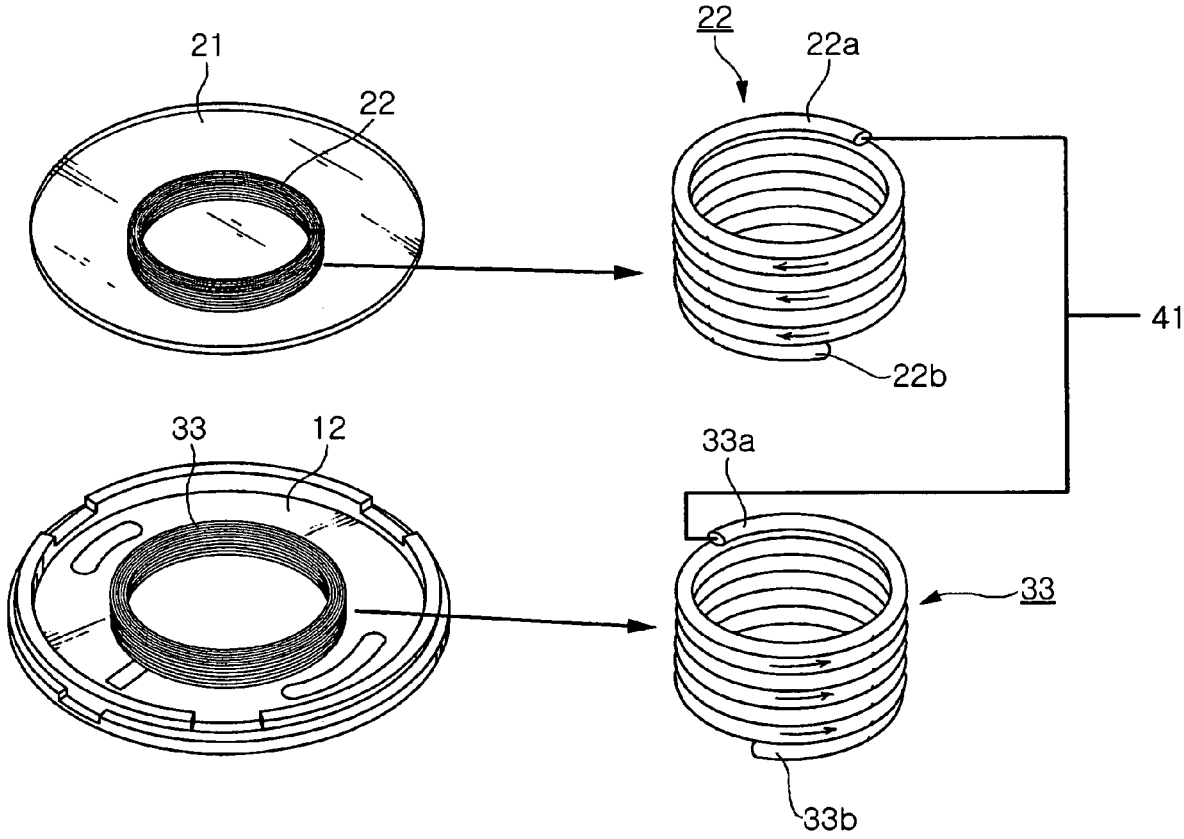
FIGS. 8 to 11 illustrate several examples for explaining the anti-vibration function of the present invention.

As a first example, the voice coil 22 cylindrically wound on the bottom of the diaphragm 21 is directed opposite to the vibration coil 33 cylindrically wound on the top of the lower cover 12 as shown in FIG. 8.

(In description of the examples, it will be defined that the voice coil 22 has a starting point 22*a* positioned on the bottom of the diaphragm 21 and a termination point 22*b* opposed to the starting point 22*a*, and the vibration coil 33 has a starting point 33*b* positioned on the top of the lower cover 12 and a starting point 33*a* opposed to the termination point 33*b*.

For example, the first terminal 41 connected with the earth terminal 51 of the melody drive unit 50 is preferably provided by earthing the starting point 22*a* of the voice coil and the termination point 33*a* of the vibration coil.

As a consequence, when an audio signal from the signal terminal 51 of the melody drive unit 50 is applied simultaneously to both of the voice and vibration coils in response to user's switch selection, electric currents of the opposite direction (as represented by arrows) flow through the voice and vibration coils.

This causes electromagnetic forces applied onto the vibration unit by the voice and vibration coils to be coaxial with and directed counter to each other so that the electromagnetic forces are canceled out thereby preventing the vibration of the vibration unit.

Figure 9:
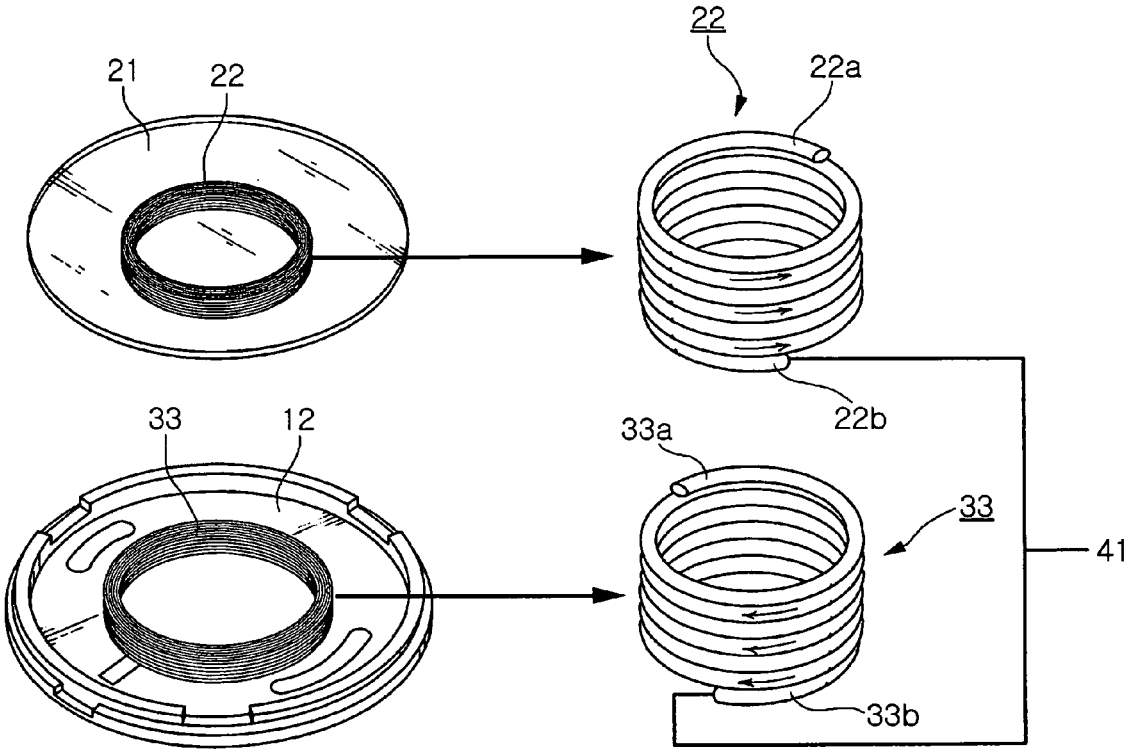

As a second example, in case that the voice and the vibration coils 22 and 33 are wound in the opposite direction as shown in FIG. 9, the termination point 22*b* of the voice coil is preferably earthed with the starting point 33*b* of the vibration coil.

Figure 10:
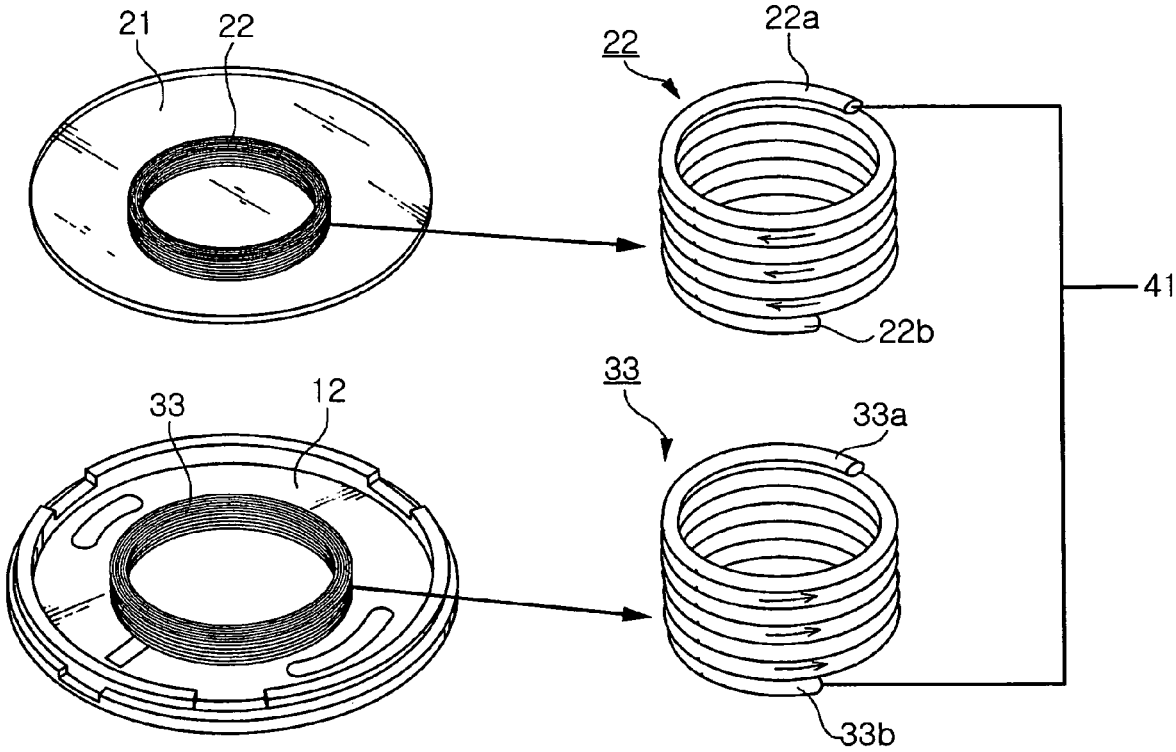

As a third example, the voice and vibration coils 22 are wound in the same direction as shown in FIG. 10.

The first terminal is preferably formed by earthing the starting point 22*a* of the voice coil with the starting point 33*b* of the vibration coil.

Figure 11:
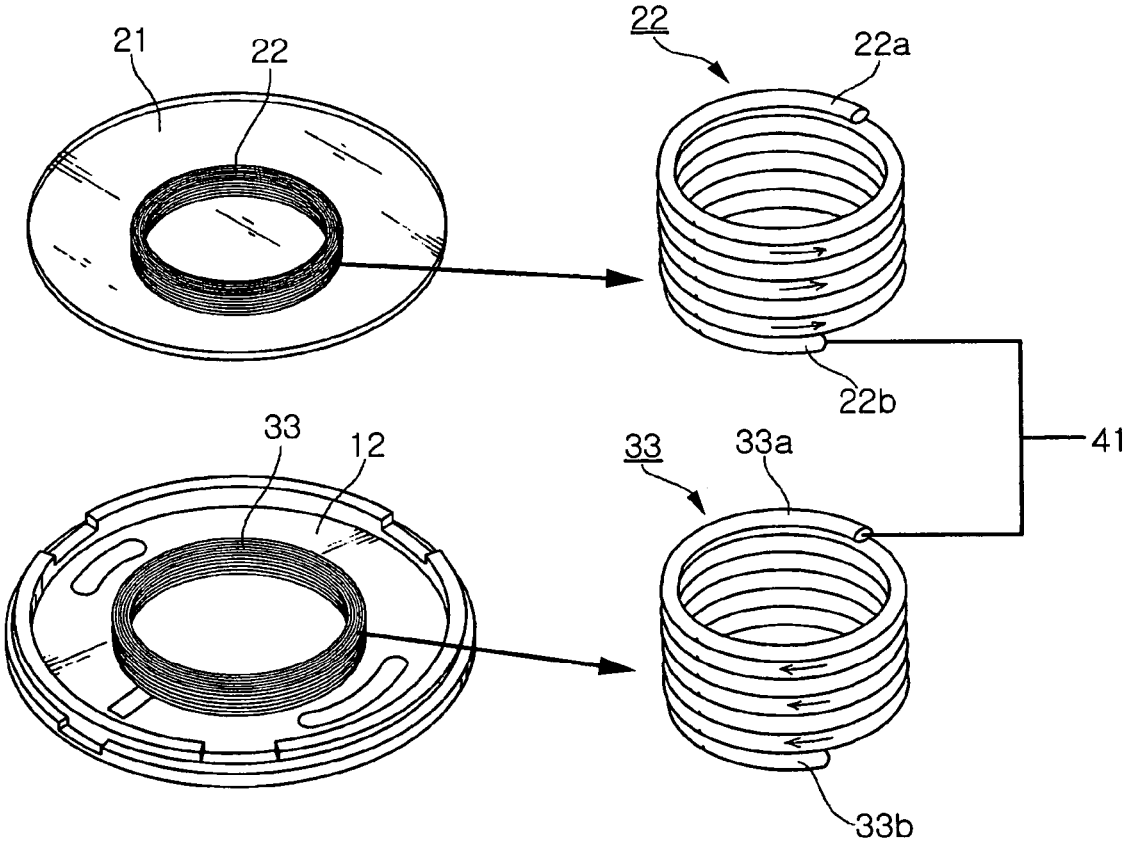

Also, as a fourth example, the voice and vibration coils 22 and 33 are wound in the same direction as shown in FIG. 11.

The first terminal 41 is preferably formed by earthing the termination point 22*b* of the voice coil with the termination point 33*a* of the vibration coil.

Figure 12:
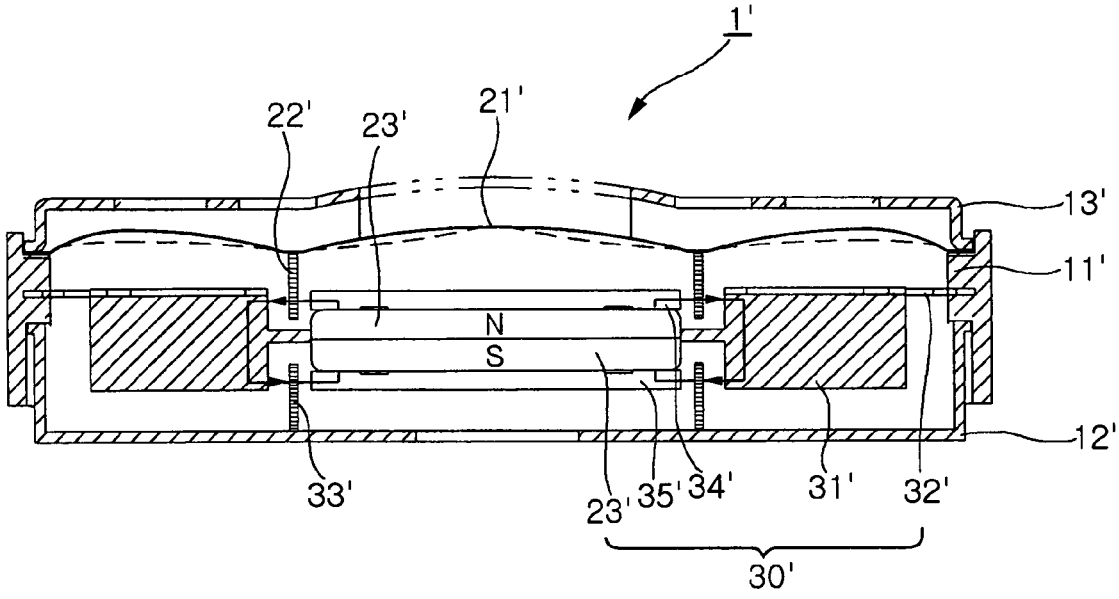
FIG. 12 illustrates a side section of a multi-function actuator according to a second embodiment of the present invention.

FIG. 12 illustrates a side section of a multi-function actuator according to a second embodiment of the present invention, as will be described in comparison with the afore-described actuator according to the first embodiment of the present invention.

An actuator 1' according to the second embodiment of the present invention includes a vibration unit 30' having a cylindrical magnet 23'.

It is preferred that the voice and vibration coils 22' and 33' are vertically arranged outside the cylindrical magnet 23'.

The actuator also includes plate yokes 34' and 35' in the top and bottom of the cylindrical magnet 23', respectively, as shown in FIG. 12.

In this case, the coils 22' and 33' generate magnetic fluxes in the opposite direction owing to the configuration of the cylindrical magnet 23'.

That is, lines of magnetic force from the N pole of the cylindrical magnet 23' is directed through the upper plate yoke 34', the voice coil 22' and a yoke 31' in their order to the S pole of the magnet 23' thereby forming a magnetic field.

In this case, the lines of magnetic force directed to the S pole of the magnet 23' pass through the vibration coil 33' in the opposite direction as the voice coil 22' (as designated with arrows).

Accordingly, the actuator 1' requires electric currents to flow through the voice and vibration coils 22' and 33' in the same direction in order to cancel out the vibration of the vibration unit 30' as a reaction to the vertical vibration of the diaphragm 21' during sound generation unlike to the afore-described first embodiment.

When an audio signal is applied simultaneously to both of the voice and vibration coils 22' and 33' in response to user's switch selection, the electric currents flowing through the coils 22' and 33' have the same direction. Electromagnetic forces generated by the voice coil 22' and the vibration coil 33' are directed counter to each other according to Fleming's left hand rule. This cancels out the electromagnetic forces from the voice and vibration coils 22 and 33 thereby preventing the vibration of the vibration unit 30'.

Of course, if the switch is turned off in response to user selection, the audio signal is applied to only the voice coil 22' so that the vibration unit 30' is generated as a reaction to the vertical vibration of the diaphragm 21'.

In order that electric currents flow through the voice and vibration coils 22' and 33' in the same direction when the switch is turned on in response to user selection, it is preferred, in a first example, that the voice and vibration coils be wound in the opposite direction and a starting point of the voice coil is earthed with that of the vibration coil.

That is, when an audio signal is applied simultaneously to both of the voice and vibration coils 22' and 33' from a signal terminal of the melody drive unit in response to user's switch selection, electric currents of the same direction flow through the voice and vibration coils 22' and 33'.

As a result, electromagnetic forces applied onto the vibration unit 30' by the voice and vibration coils 22' and 33' become coaxial with and directed counter to each other to cancel out themselves thereby preventing the vibration of the vibration unit 30'.

In a second example, it is preferred that the voice and vibration coils are wound in the opposite direction and the termination points of the voice and vibration coils are earthed.

In a third example, it is preferred that the voice and vibration coils are wound in the same direction and the starting point of the voice coil the termination point of the vibration coil are earthed.

In a fourth example, it is preferred that the voice and vibration coils are wound in the same direction and the termination point of the voice coil and the starting point of the vibration coil are earthed.

While the present invention has been described with reference to the particular illustrative embodiments, they are illustrative only and the present invention is not limited thereto.

The multi-function actuator of the present invention can prevent the vibration of the vibration unit in response to user's switch selection during sound generation.

Furthermore, according to the present invention, when the switch is turned on by a user, an audio signal is applied to both of the voice and vibration coils and electromagnetic forces onto the vibration unit by the voice and vibration coils are directed counter to each other to cancel out themselves thereby preventing unnecessary vibration during sound generation.

Moreover, the present invention has the common magnet for the magnetic circuit formed around the voice and vibration coils and the diaphragm directly connected to the housing to form a space capable of obtaining the maximum mass from the same volume thereby efficiently improving the structure of the actuator.

While the present invention has been shown and described in connection with the preferred embodiments, it will be apparent to those skilled in the art that modifications and variations can be made without departing from the spirit and scope of the present invention as defined by the appended claims.

What is claimed is:

1. A multi-function actuator comprising:

a diaphragm for generating sound;

a voice coil for vibrating the diaphragm in response to an audio signal;

a vibration coil placed on a central axis coaxial with the voice coil for generating vibration in response to the audio signal or a vibration signal;

a vibration unit including a magnet for generating a magnetic field to both of the voice coil and the vibration coil and a yoke having a predetermined mass, the vibration unit being vertically vibrated by an electromagnetic force produced from at least one of the voice coil and the vibration coil; and a switch for selectively applying the audio signal to the vibration coil, wherein when an audio signal is applied simultaneously to both of the voice and vibration coils in response to the operation of the switch, the electromagnetic forces applied onto the vibration unit by the voice and vibration coils become coaxial with and counter to each other to cancel out themselves thereby preventing the vibration of the vibration unit.

2. The multi-function actuator according to claim 1, wherein the magnet is annular shaped.

3. The multi-function actuator according to claim 2, wherein the voice coil is placed outside the annular magnet, and wherein the vibration coil is placed inside the annular magnet.

4. The multi-function actuator according to claim 2, wherein the voice coil is placed inside the annular magnet, and wherein the vibration coil is placed outside the annular magnet.

5. The multi-function actuator according to claim 1, wherein the magnet is cylindrically shaped.

6. The multi-function actuator according to claim 5, wherein the voice and vibration coils are arranged vertically outside the cylindrical magnet.

* * * * *